US006666163B2

(12) United States Patent
Pastor et al.

(10) Patent No.: US 6,666,163 B2
(45) Date of Patent: Dec. 23, 2003

(54) ADJUSTABLE BOAT TOP

(76) Inventors: David Pastor, 12079 Berlin Rd., S. Rockwood, MI (US) 48179; Leisa Pastor, 12079 Berlin Rd., S. Rockwood, MI (US) 48179

( * ) Notice: Subject to any disclaimer, the term of this patent is extended or adjusted under 35 U.S.C. 154(b) by 0 days.

(21) Appl. No.: 10/043,435

(22) Filed: Jan. 10, 2002

(65) Prior Publication Data

US 2003/0127036 A1 Jul. 10, 2003

(51) Int. Cl.[7] ..... B63B 17/00
(52) U.S. Cl. ..... 114/361
(58) Field of Search ..... 114/343, 361; 135/88.01, 120.1, 120.4, 141, 153

(56) References Cited

U.S. PATENT DOCUMENTS 3,823,431 A 7/1974 Miller
4,683,900 A 8/1987 Carmichael
5,016,558 A 5/1991 Oehler
5,044,298 A 9/1991 Pepper et al.
5,520,139 A 5/1996 King et al.
5,706,752 A 1/1998 Menne, Jr. et al.
5,904,114 A 5/1999 Wright
5,983,824 A 11/1999 Hernandez
6,349,666 B1 * 2/2002 Hastings ..... 114/361

* cited by examiner

*Primary Examiner*—Ed Swinehart
(74) *Attorney, Agent, or Firm*—Rader, Fishman & Grauer PLLC

(57) ABSTRACT

This invention includes an adjustable boat top, that can be lowered in order to permit the boat to travel under bridges and other obstructions that might otherwise preclude the passage or movement of the boat. The boat top is lowered as the boat top slides forward to the front to the boat. The top frame of the boat top is supported by a forward frame and a rearward frame, which may be connected to pivots on the deck surface. In lowering the boat top, the pivots are unlocked so that the forward frame and rearward frame can pivot forward. In a preferred embodiment of the invention, the raising and lowering of the boat top uses a piston assist, but the raising and lowering of the boat top can also be done manually. Preferably, the area of the boat from the pivots out to the side of the boat are not impeded by the boat top in either raised or lowered positions.

40 Claims, 5 Drawing Sheets

ADJUSTABLE BOAT TOP

BACKGROUND OF THE INVENTION

The present invention relates in general to boat tops that can be adjusted. More specifically, the present invention includes an adjustable boat top that can be lowered sufficiently close to the surface of the boat, for example, to permit the boat to travel under bridges and other obstructions that would otherwise preclude the movement and passage of a boat due to the height of a boat top.

Conventional boat tops provide protection from rain, intense sunlight, and other environmental factors. However, in many instances, a boat top may be a hindrance to a boater. A boat top can make the boat taller than it otherwise would be. Sometimes a boat cannot travel to a particular destination because of a bridge, low hanging tree branches, or other obstruction. It is often desirable to have the option of lowering the boat top to avoid such obstructions, while still allowing the boat to function in a normal manner.

Some adjustable boat tops are known, but there are several significant limitations with the existing art. Many such adjustable tops or covers do not permit the boat to operate in its normal manner when the top is adjusted or lowered. It is desirable for an adjustable top to have minimal impact on the operation of the boat.

Further, many adjustable tops or covers require that the top be folded, substantially altered, or even removed entirely from the boat in order to lower the top or cover. The lowering or raising of such boat tops or covers often requires a significant amount of time and effort on the part of the boater. Such functionality can also limit the potential strength of the boat top. It is desirable that an adjustable boat top require minimal time and effort to raise or lower the boat top. It is also desirable for the ability to raise or lower the boat top to have minimal impact with respect to the strength or rigidity of the boat top.

Moreover, adjustable tops in the existing art often impede a boater's use of the sides of the boat when the top is lowered. For example, in some prior art boat tops, one cannot fish off the side of a boat that has a lowered boat top. Such boats commonly have tops connected at the outermost edges of the boat. It is desirable for an adjustable boat top to be connected to the surface of the boat within the outer edges of the boat so that the sides of the boat are usable even when the boat top is in a fully lowered position.

SUMMARY OF THE INVENTION

This invention relates in general to an adjustable boat top, which can be lowered closer to the surface of the boat in order to permit the boat to travel under bridges and other obstructions that may otherwise preclude the movement of the boat.

The boat top is lowered as the boat top slides forward towards the front to the boat. The top frame of the boat top is supported by a forward frame and a rearward frame, both of which are connected to pivot structures on the deck surface. The pivot structures are unlocked so that the forward frame and rearward frame can pivot forward, allowing the boat top to be lowered. The process can be reversed, raising the top by pivoting the forward frame and rearward frame rearward. In a preferred embodiment of the invention, the raising and lowering of the boat top is powered by a hydraulic piston. In alternative embodiments, the raising and lowering of the boat top can be done manually. The area of the boat vertically down from the pivots up to the top frame, and horizontally in from the pivot structures out to the edges of the boat, may be left unimpeded or obstructed by the boat top in either raised or lowered positions.

DETAILED DESCRIPTION OF THE PREFERRED EMBODIMENT

A. Boat Top Structure

Figure 1:
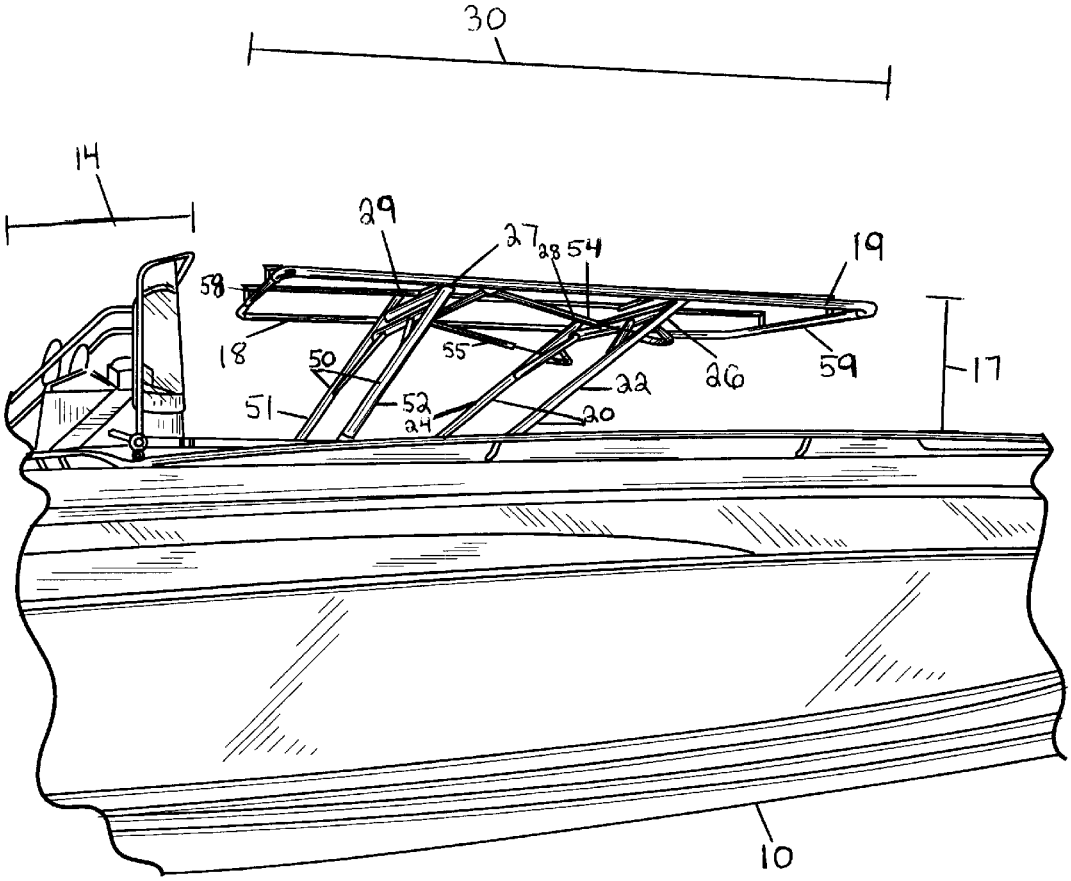
FIG. 1 shows an angled side view of the boat top in a partially lowered position, and a partial view of a boat.

Referring now to the drawings, FIG. 1 discloses an example of an angled side view of a boat 10 and a boat top 17 in a partially lowered position. At the top of the boat top 17 is a top frame 30 which is supported by a forward frame 20 and a back or rearward frame 50. In a preferred embodiment, the forward frame 20 includes a first forward leg 22 and a second forward leg 24. Similarly, the rearward frame 50 preferably includes a first rearward leg 52 and a second rearward leg 51. In alternative embodiments, the forward and rearward frames 20 and 50 may have as few as one leg, or as many legs as desired (i.e., to the extent that the raising and lowering of the top to sufficient heights is not materially impeded). If desired, the forward frame 20 may even have a different number of legs than the rearward frame 50.

The top frame 30, forward frame 20, and rearward frame 50 are preferably comprised primarily of hollow aluminum pipe. However, the frames 20, 30, and 50 are not material dependent and can utilize various different physical structures and can be comprised of a wide variety of different materials such as plastic, fiberglass, metal, wood, or any other substance capable of appropriately supporting the structure of the boat top 17. The top frame 30 can be covered in a cloth, plastic, wood, or virtually any other form of cover to achieve the environmental protection desired from the boat top 17. The boat top 17 can incorporate a symmetrical design from front view or rear view perspective, with the first side or starboard side of the boat top 17 being a mirror image of the second side or port side of the boat top 17. The structure of the forward frame 20 can also be identical or substantially similar to the rearward frame 50, but such an embodiment is not preferred because the lowering of the boat top 17 in a more "horizontal" manner relative to the deck, is preferably achieved by the coordinated pivoting forward of the rearward frame 50, the forward frame 20, and the top frame 30. Often, this is facilitated by including an angle or bend in the legs of one of the frames 20, 50 (for an example see the bend in the rearward leg 52 in FIG. 2)

A top 26 portion of the first forward leg 22 supports and is connected to the top frame 30. Similarly, a top portion 28 of the second forward leg 24 supports and is connected to the top frame 30. The first forward leg 22 and the second forward leg 24 can be connected by a forward cross member 42, hidden from view in FIG. 1 by the boat 10. The forward cross member 42 can also be referred to as the "third cross member." Preferably, the forward cross member 42 can be slidably adjusted upwards or downwards, allowing a boater to adjust how far forward and downward the boat top 17 can be lowered, as generally described in greater detail below. In a preferred embodiment, a first cross member 46 and a second cross member 47 connect the forward frame 20 to the rearward frame 50. Such cross members 46, 47 are further described below, and can be viewed in FIGS. 2, 2A and 3.

Although not a requirement, the boat 10 can be controlled or operated from a control area 14. When the boat top 17 is in a fully raised position, the control area 14 is preferably covered by the boat top 17 and the top frame 30. When the boat top 17 is in a fully raised position, a rearward edge 58 of the boat top 17 is preferably to the rear of the control area 14 and a forward edge 59 is preferably closer to the forward side of the boat 10 than the control area 14. When the boat top 17 is in a lowered position, the control area 14 is preferably to the rear of both the forward edge 59 and the rearward edge 58 of the boat top 17. Regardless of whether the boat top 17 is in a fully raised or fully lowered state, or even in some in-between state; the locations the first edge 19 and second edge 18 of the top frame 30 are preferably independent of direct connection to the surface area or the railings 37 of the boat 10. In a preferred embodiment, the position of the outer edges of the boat 10 are to the outside of positions of the first and second edges 19 and 18 of the boat top 17. This permits the area from the outer edges 19 and 18 of the boat top 17 to the outer edges of the boat to be unimpeded and unaffected by the raising or lowering of the boat top 17.

Beneath the forward frame 20 and rearward frame 50 is the surface of the boat. It can be desirable but not necessary for the top frame 30 to be substantially parallel with the surface of the boat 10. In a preferred embodiment of the invention, the base of the first forward leg 22 includes a first forward pivot structure 32 and the base of the second forward leg 24 includes a second forward pivot structure 34. Similarly, the base of the first rearward leg 52 preferably includes a first rearward pivot structure 44 and the base of the second rearward leg 51 preferably includes a second rearward pivot structure 45. Examples of the pivot structures can be viewed in FIGS. 2 and 3. The unlocking of the pivot structures 32 and 34 on the surface 36 of the boat can facilitate the lowering or raising of the boat top 17. A wide variety of pivot structures are known in the art, and may be used with the present invention.

If desired, the raising and lowering of the boat top 17 can be assisted by one or more assist mechanisms connecting the top frame 30 to either the forward frame 20 or the rearward frame 50. For example and without limitation, a first assist 54 can connect the first forward leg 22 to the top frame 30. A second assist 55 can connect the second forward leg 24 to the top frame 30. In alternative embodiments, no assists are necessary, but such embodiments may include one, three, or even more than three assists. The assist mechanisms 54 and 55 can include hydraulic pistons filled with gas and accompanied by spring mechanisms. If desired, the pistons can be activated in a powered and automatic fashion with the push of a button. Further, numerous powered or manual mechanisms may be used to assist a boater in the raising or lowering of the boat top 17. Assist mechanisms can incorporate a wide variety of conventional structures and components to accomplish the aforementioned tasks. However, the present invention does not require assist mechanisms in order to function.

B. Side View of Boat Top in a Fully Raised Position

Figure 2:
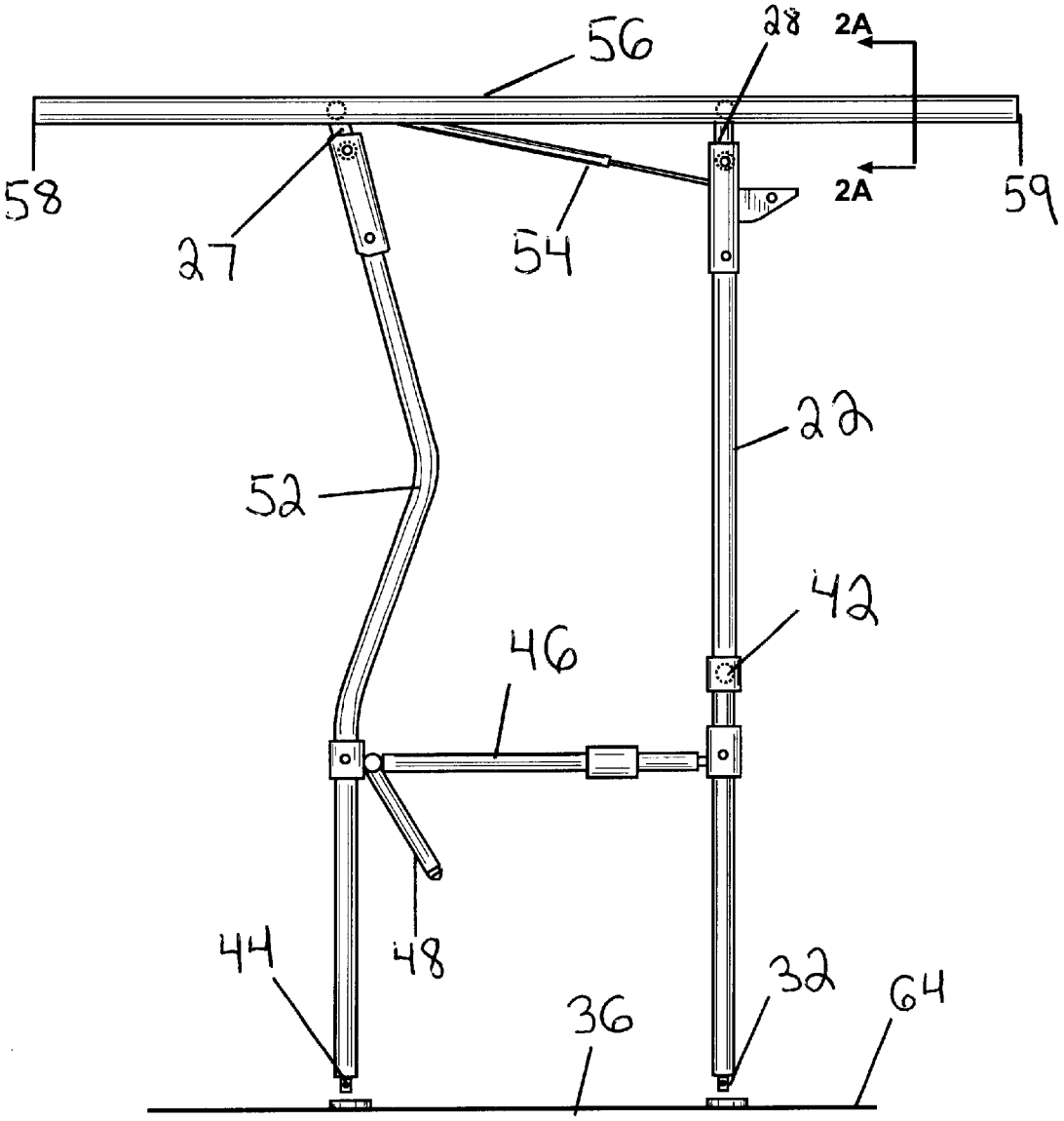
FIG. 2 shows a side view of the first side of the boat top in a fully raised position.

FIG. 2 discloses an example of view of a first side of the boat top 17 in a fully raised position. In a preferred embodiment, the second side of the boat top 17 is identical or substantially similar to the first side of the boat top 17. Thus, the top frame 30, forward frame 20, and rearward frame 50 can be symmetrical when viewed from the front, e.g. the right and left sides may be mirror images of each other. Thus, each of elements and components on the first, right, or starboard side of the boat top 17 can block from view in FIG. 2, a symmetrical element or component on the second, left, or port side of the boat top 17 when the boat top 17 is viewed from the side.

At the top of the boat top 17 is the top frame 30. The top frame 30 is preferably supported by and connected to the top of the forward frame 20 and the top of the rearward frame 50. It is preferable but not necessary for the top frame 20 to be substantially parallel with the deck surface of the boat 10. The boat top 17 can function properly with an irregular deck surface or with an irregular shaped top frame 30.

In a preferred embodiment, the top frame 30 includes a first slide mount 56 and a second slide mount 57. The first slide mount 56 is preferably supported by the first forward leg 22 and the first rearward leg 52. Preferably, the first forward leg 22 is connected to the first slide mount 56 by the top 26 portion of the first forward leg 22 and the first rearward leg 52 is connected to the first slide mount 56 by the top 27 portion of the first rearward leg 52. A second slide mount 57 can be similarly connected to the second forward leg 24 and the second rearward leg 51.

Further, in a preferred embodiment, the first forward pivot structure 32 connects the first forward leg 22 to the surface of the boat 10. The first rearward pivot structure 44 can connect the first rearward leg 52 to the surface of the boat 10. A second rearward leg 53 can be connected to the surface of the boat 10 by a second rearward pivot structure 45, and a second forward leg 34 can be connected to the surface of the boat 10 by a second forward pivot structure 34.

Preferably, a first cross member 46 connects the first forward leg 22 to the first rearward leg 52. In an embodiment with symmetrical left and right sides, a second cross member 47 can connect the second forward leg 24 to the second rearward leg 51. The slidably adjustable forward cross member 42 connects the first forward leg 22 to the second forward leg 24. Alternative embodiments can incorporate numerous different variations with respect to cross members. Cross members are often useful for facilitating the coordinated raising or lowering of the boat top 17, but are not needed for the present invention to function. The third cross member 42 (which can also be called the slidably adjustable forward cross member 42) can allow a boater to control or adjust the ratio of horizontal to vertical distances involved in the lowering of the boat top 17. The lowering of the boat top 17 can move the boat top 17 in a forward direction as the boat top 17 is lowered.

Attached to the first rearward leg 48 is preferably the top end of a first brake 48. The bottom end of the first brake 48 does not touch other components of the boat top 17 while the boat top 17 is in a fully raised position in a preferred embodiment. A second brake 49 can be attached to the second rearward leg 51. VELCRO straps, string, rope, or other mechanical constraints may be used to restrain the unattached end of the brakes 48 and 49 when the boat top 17 is in a fully raised position, until such time as the boat top 17 is to be lowered.

When the boat top 17 is in a fully lowered position, the bottom end of the first brake 48 can rest against the first forward pivot structure 32 and the second brake 49 can rest against the second forward pivot structure 34. It can serve to resist the force of the pivot structures 32 and 34 against the brakes 48 and 49 and prevent movement of the boat top 17 beyond a desired fully lowered position.

In order to facilitate the raising and lowering of the boat top 17, one or more assist mechanisms can be connected to the top frame 30. An assist can be attached at one end to the top frame 30 and to the front 20 or rearward 50 frame on the other end of the assist. More than one assist 54 can be used. The first assist 54 can be connected to the first front leg 22 and the first slide mount 56 and the second assist 55 can be connected to the second front leg 24 and the second slide mount 57. The piston assists 54 can be gas filled hydraulic pistons with a spring mechanism, but alternative embodiments can utilize other forms and degrees of automation. The assists are generally described above.

C. Slide Mount View

Figure 2A:
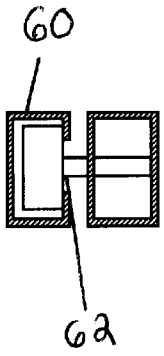
FIG. 2A shows a view of the slide mounts in the top frame.

FIG. 2A discloses an example a view of a slide mount representative of both the first slide mount 56 and the second slide mount 57. A roller 62 can permit movement along a rail 60. Preferably, the roller 62 includes a first rail 60 for the first slide mount 56 and a second rail 60 for the second slide mount 57. In most instances, at least two rollers 60 are used for each slide mount to facilitate the lowering and raising of the boat top 17. Alternative embodiments may utilize fewer than two rollers 60.

In a preferred embodiment, the lowering of the boat top 17 involves moving the boat top 17 in a forward direction as the rollers 62 roll forward in the first and second rails 60, connected respectively in the first and second slide mounts 56 and 57. There are many potential different configurations of rails to slide mounts that could be incorporated by an embodiment of the invention.

D. Lowering the Boat Top

To facilitate the lowering of the boat top 17, the pivot structures 32, 34, 36, and 37 connecting the boat top 17 to the surface 37 of the boat can be released or unlocked to permit rotation. The pivots structures 32, 42, 36, and 37 can incorporate a wide variety of different techniques and structures for permitting or precluding movement of the boat top 17. Any pivot structure capable of being locked/unlocked to either permit or not permit movement by the boat top 17 can be used. The unlocking or release of the pivot structures 32, 34, 36, and 37 can be accomplished by either manual or powered means. If powered means are used, the same triggering mechanism for triggering the assists 54 and 55 can also be used to trigger the unlocking of the pivot structures 32, 34, 36, and 37. Unlocking the pivot structures permits the forward frame 20 and rearward frame 50 to pivot towards a forward section 64 of the boat and boat surface 36.

In a preferred embodiment, the top frame 30 remains "substantially rigid" while in a fully raised position, a fully lowered position, in a state of being lowered, or a state of being raised. As used herein, the term "substantially rigid" means that the structure of the top frame 30 remains substantially unaltered, i.e., not folded, rolled up, bent, twisted, collapsed etc., so as to maintain substantially the same overall dimensions and measurements in the lowered position as in the fully raised position.

Upon unlocking or release, the forward frame 20 and rearward frame 50 may be pivoted towards the forward section 64 of the boat. In a preferred embodiment, all portions of the boat top 17 are pivoted in a coordinated manner. This movement of the boat top 17 can be aided by whatever assistance 54 mechanism is incorporated into the particular embodiment of the invention. This process can involve pivoting forward all of the legs 20, 22, 50, and 51 included in the forward frame 20 and rearward frame 50. While the frames 20 and 50 are pivoting forward, rollers 62 allow the top frame 30 to be lowered while the top frame 30 moves towards the forward section 64 of the boat. The top frame 30 preferably remains rigid and substantially parallel with surface 36 of the boat as the boat top 17 is lowered. In alternative embodiments, the top frame 30 does not need to be substantially parallel with the surface 36 of the boat and the top frame 30 can be subject to folding or other manipulation. The areas between the out edges of the boat top 17 and the boat 10 itself can remain unimpeded and unblocked during the lowering of the boat top 17, as is described in greater detail below.

The boat top 17 can continue to be lowered while moving towards the forward section 64 of the boat surface until further pivoting movement is prohibited by one or more brakes 48 and 49, some other structure in the boat top 17, or by some form of recess or external means associated with the front of the boat, such as a pedestal, horizontal formation, brace, stand or a "catch" on the front of the boat 10 that prohibits further forward movement by the boat top 17 and/or secures the top 17. When the boat top 17 is in a fully lowered position, a rear member 58 on the top frame 30 can be positioned horizontally closer to the forward section of the boat than the forward pivots 44 and 32. The boat can be controlled from the section of the boat underneath the boat top 17 and top frame 30 while the boat is being raised or lowered, and when the boat top 17 is in a fully raised or fully lowered position.

E. Side View of the Boat Top in a Fully Lowered Position

Figure 3:
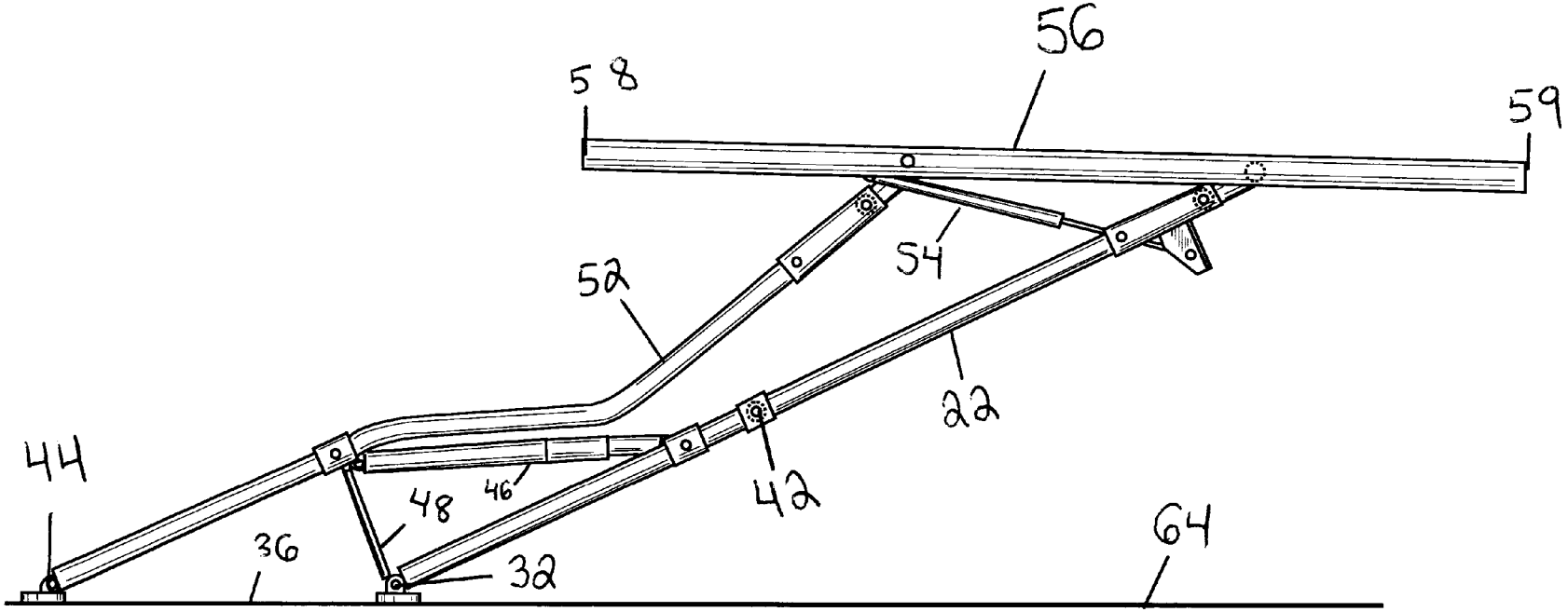
FIG. 3 shows a side view of the first side of the boat top in a fully lowered position.

FIG. 3 illustrates an examples of a first side view of the boat top 17 in a fully lowered position. FIG. 3 is an example of a first side of a boat top in a fully lowered position. In the example in FIG. 3, the first side of the boat top 17 is symmetrical with the second side of the boat top 17, and thus the first side blocks the second side from view in the Figure. However, the present invention does not require symmetrical sides in order for the invention to function. Moreover, the invention does not require two-legged front and rear frames 50 and 20 in order for the boat top 17 to function.

A rear member 58 of the top frame 30 can be horizontally closer to the forward section 64 of the boat 10 than the first forward pivot structures 32 and 34. All four legs 22, 24, 51, and 52 can be pivoted as far in the forward direction as the brakes 48 and 49, or other intended obstruction permit.

The coordinated fashion of the pivoting of the frames can be evidenced by the continued symmetrical nature of the first and second sides of the boat top 17 even when the boat top is in a fully lowered position. In a preferred embodiment, the second slide mount 57 is symmetrical with the first slide mount 56 and the second forward leg 24 is symmetrical with the first forward leg 22. Preferably, the second rearward leg 51 is symmetrical with the first rearward leg 52 and the second assist 55 is symmetrical with the first assist 54. The second cross member 47 is also preferably symmetrical the first cross member 46, but need not be. Alternative embodiments may utilize different frame structures including a non-symmetrical frame structures as discussed above, and thus the first side of the boat top 17 need not always be symmetrical with the second side of the boat top 17.

F. Raising the Boat Top

Raising the boat top 17 can be essentially the same process as lowering the boat top 17, except with the steps generally reversed. In a preferred embodiment, the assists 54 and 55 are used to power the pivoting backwards of the boat top 17. The same ends may be accomplished through a variety of manual or other means in alternative embodiments. Pivoting the boat top 17 in the rearward direction will preferably release the pressure on the brakes 48 and 49 or other form of intentional obstruction (if any) from needing to restrain the forward and rearward frames 20 and 50. As the boat top 17 is raised, it also moves in a rearward direction towards the rear of the boat top 17 and the boat. Rollers 62 may move rearward along the rails 60.

The top frame 30 can remain substantially parallel with the deck surface 36 during the raising of the boat top 17. The top frame 30 can remain substantially rigid during the raising of the boat top 17. When the boat top 17 reaches a fully raised position, the pivots 32, 34, 44, and 45 can preclude any more movement in the rearward direction, and the pivots 32, 34, 44, and 45 can then be locked.

G. Attachment of the Boat Top to the Boat

Figure 4:
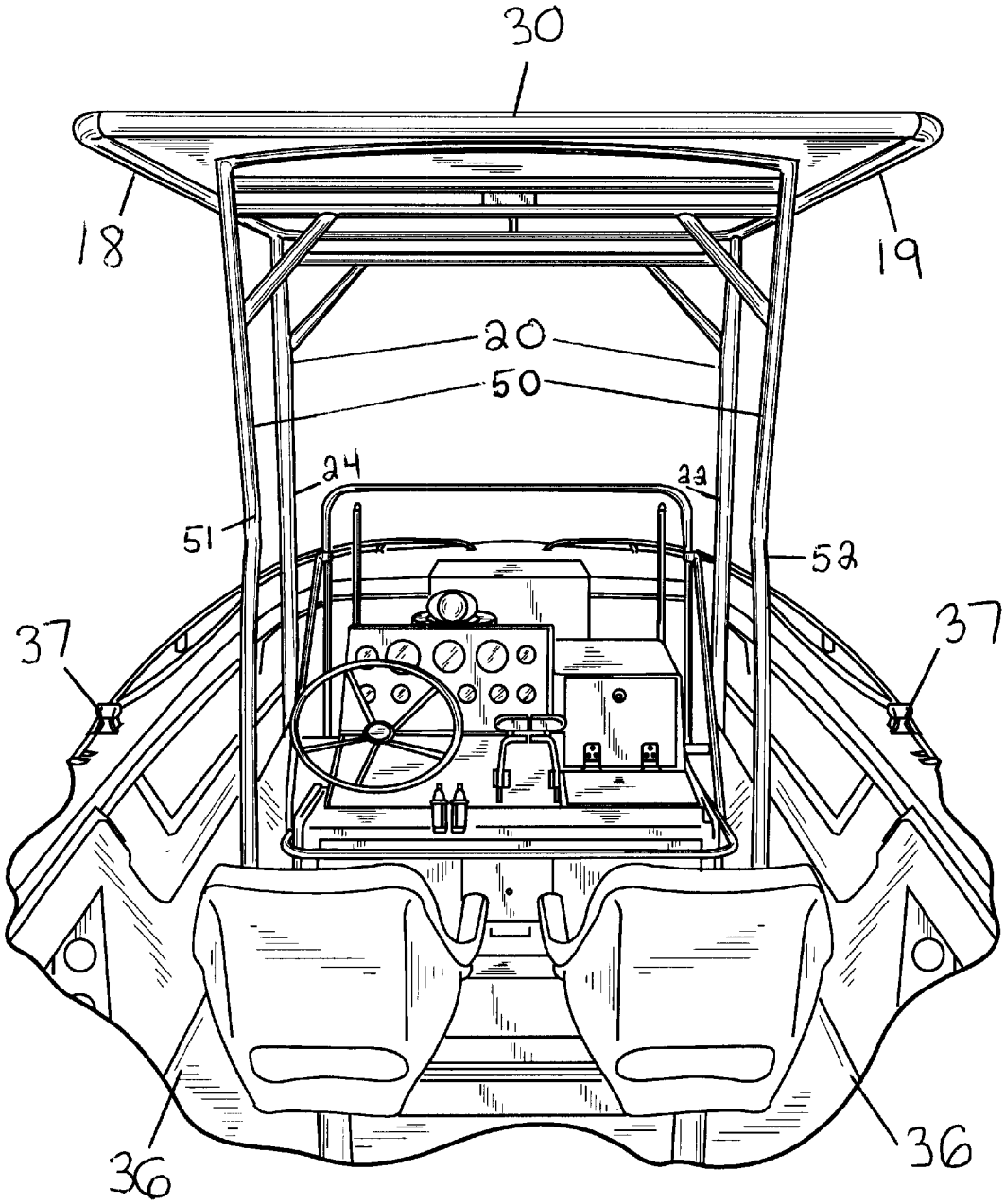
FIG. 4 shows a rear view of a boat and the boat top in a fully raised position.

Unlike some prior art flexible boat tops, the present invention does not require the boat top 17 to be attached to the outer side or rail of the boat 10. FIG. 4 is an example of a boat top 17 in a fully raised position. The boat top 17 can be attached to the surface 36 of the boat 10, and thus does not need to be attached to the outer railing of the boat 37. Preferably, the outer right edge 37 of the boat 10 is further to the right than the right edge 19 of the top frame 30 and the outer left edge 37 of the boat 10 is further to the left than the left edge 18 of the top frame 30. The lowering of the boat top 17 can be accomplished without impeding a boater's use of areas between the right edge 19 of the top frame 30 and the right edge 37 of the boat 10, and between the left edge 18 of the top frame 30 and the left edge 37 of the boat 10.

Figure 5:
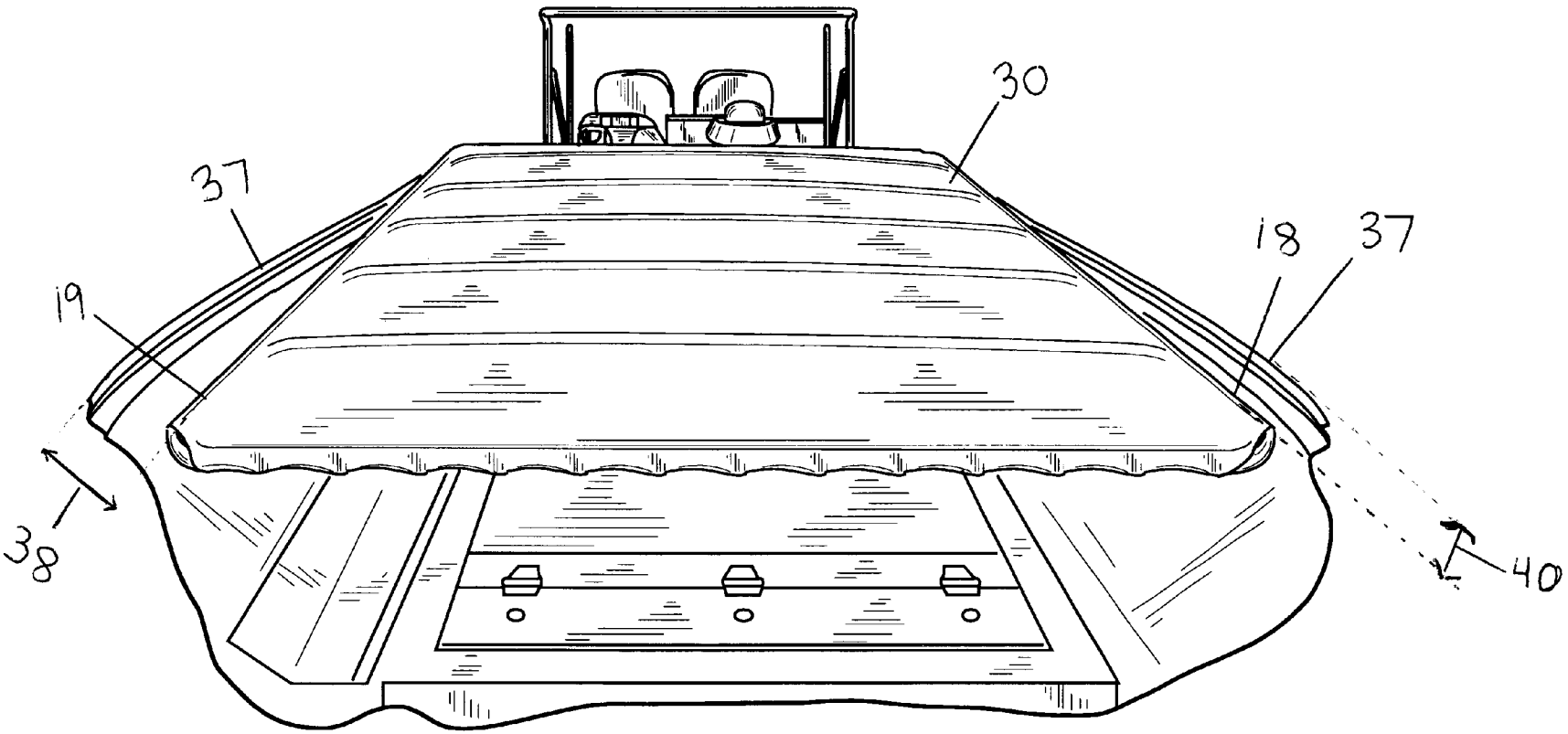
FIG. 5 shows a front view of a boat and the boat top in a fully lowered position.

The unimpeded areas can be seen in FIG. 5, which is an example of a boat top 17 in a fully lowered position. The unimpeded areas can be as large or small as desired. On the port side of the boat 10, the area between the edge 18 of the boat top 17 and the surface 37 of the boat 10 can be unimpeded. On the starboard side of the boat 10, the area between the edge 19 of the boat top 17 and the surface of the boat 10 can be unimpeded.

Raising of the boat top 17 does not affect use of the first area 40 of the second area 38. The boat can be controlled from the area under the top frame 30 and the boat top 17 during the raising of the boat top 17.

While exemplary embodiments of this invention have been described in detail above, such disclosure is by way of illustration and not limitation. Those skilled in the art will readily appreciate that many modifications are possible in the exemplary embodiments, as shown and/or described above, without materially departing from the novel teachings and advantages of this invention. Accordingly, all such modifications are intended to be included within the scope of this invention as defined in the following claims, which should be construed as broadly as the prior art will permit.

What is claimed is:

1. A boat top assembly for a boat having a deck surface and a forward section, said assembly comprising:

a first forward leg adapted for connection to the boat, said first forward leg including a top and a first forward pivot structure that permits said leg to pivot forward about said first forward pivot structure;

a first rearward leg adapted for connection to the boat, said first rearward leg including a top and a first rearward pivot structure that permits said first rearward leg to pivot forward about said first rearward pivot structure;

a top frame connected to the top of said first forward leg and the top of said first rearward leg, said top frame including a rear member;

wherein the coordinated pivoting forward of said first forward leg and said first rearward leg lowers said top frame in a forward direction toward the forward section of the boat and wherein said top frame is substantially unaltered when said top frame is in a fully lowered position; and wherein, when said top frame is in the fully lowered position, said rear member of said top frame is positioned more forward in the forward section of the boat than said first forward pivot structure.

2. A boat top assembly as in claim 1, wherein the boat can be operated when said top frame is in a fully lowered position.

3. A boat top assembly as in claim 1, wherein the boat can be operated during the lowering of said boat top assembly.

4. A boat top assembly as in claim 1, wherein the boat is operated from the area underneath said top frame when said top frame is in a fully raised position.

5. A boat top assembly as in claim 1, wherein said top frame is substantially parallel with the deck surface of the boat when said top frame is in a fully lowered position.

6. A boat top assembly as in claim 1, wherein said top frame remains substantially unaltered during the raising and lowering of said top frame.

7. A boat top assembly as in claim 1, wherein the boat includes a starboard section located on the starboard side of said pivot structures, and the starboard section is uncovered by said top frame when said top frame is in a fully lowered position.

8. A boat top assembly as in claim 1, wherein the boat includes a port section located on the port side of said pivot structures, and the port section is uncovered by said top frame when said top frame is in a fully lowered position.

9. A boat top assembly as in claim 1, further comprising:

a second forward leg adapted for connection to the boat, said second forward leg including a top and a second forward pivot structure that permits said second forward leg to pivot forward about said second forward pivot structure; and a second rearward leg adapted for connection to the boat, said second rearward leg including a top and a second rearward pivot structure that permits said second rearward leg to pivot forward about said second rearward pivot structure;

wherein said top frame is connected to the top of said second forward leg and the top of said second rearward leg.

10. A boat top assembly as in claim 9, further comprising a first downward brake, wherein one end of said first downward brake is connected to a forward side of said first rearward leg and the other end of said first downward brake limits the distance said first rearward leg can pivot in a forward direction.

11. A boat top assembly as in claim 10, further comprising a second downward brake, wherein one end of said second downward brake is connected to a forward side of said second rearward leg and the other end of said second downward brake limits the distance said second rearward leg can pivot in a forward direction.

12. A boat top assembly as in claim 9, further comprising at least one assist connected to said top frame and a leg selected from the group consisting of said first forward leg, said second forward leg, said first rearward leg, and said second rearward leg.

13. A boat top assembly as in claim 12, wherein said assist is selected from the group consisting of a gas filled hydraulic piston and a spring mechanism.

14. A boat top assembly as in claim 12, comprising a first assist connecting said first forward leg to said top frame and a second assist connecting said second forward leg to said top frame.

15. A boat top assembly as in claim 14, wherein said first assist and said second assist are selected from the group consisting of a gas filled hydraulic piston and a spring mechanism.

16. A boat top assembly as in claim 9, further comprising at least one cross member connecting a pair of legs selected from the pairs of legs consisting of said first forward leg and said first rearward leg and said second forward leg and said second rearward leg.

17. A boat top assembly as in claim 16, wherein said cross member can be slidably adjusted along a portion of the length of said forward leg.

18. A boat top assembly as in claim 9, wherein the top frame includes a cover.

19. A boat top assembly as in claim 9, comprising:

a first cross member connecting said first forward leg and said first rearward leg, wherein said first cross member is connected to said first forward leg and said first rearward leg by leg pivots that permit said first forward leg and said first rearward leg to pivot forward towards the forward section of the boat in a coordinated manner; and a second cross member connecting said second forward leg and said second rearward leg, wherein said second cross member is connected to said second forward leg and the said second rearward leg by leg pivots that permit said second forward leg and said second rearward leg to pivot forward towards the forward section of the boat in a coordinated manner.

20. A boat top assembly as in claim 19, further comprising a third cross member connecting said first forward leg to said second forward leg.

21. A boat top assembly for a boat having a deck surface and a forward section, said boat top assembly comprising:

a first forward leg adapted for connection to the boat, said first forward leg including a top and a first forward pivot structure that permits said first forward leg to pivot forward about said first forward pivot structure;

a second forward leg adapted for connection to the boat, said second forward leg including a top and a second forward pivot structure that permits said second forward leg to pivot forward about said second forward pivot structure;

a first rearward leg adapted for connection to the boat, said first rearward leg including a top and a first rearward pivot structure that permits said first rearward leg to pivot forward about said first rearward pivot structure;

a second rearward leg adapted for connection to the boat, said second rearward leg including a top and a second rearward pivot structure that permits said second rearward leg to pivot forward about said second rearward pivot structure;

a first cross member connecting said first forward leg and said first rearward leg, wherein said first cross member is connected to said first forward leg and said first rearward leg by leg pivots to pivot said first forward leg and said first rearward leg forward towards the forward section of the boat in a coordinated manner;

a second cross member connecting said second forward leg and said second rearward leg, wherein said second cross member is connected to said second forward leg and the said second rearward leg by leg pivots to pivot said second forward leg and said second rearward leg forward towards the forward section of the boat in a coordinated manner;

a top frame connected to said top of said first forward leg, said top of said second forward leg, said top of said first rearward leg, and said top of said second rearward leg, wherein said top frame includes a rear member;

wherein the coordinated pivoting forward of said first forward leg, said second forward leg, said first rearward leg, and said second rearward leg move and lower said top frame forward toward the forward section of the boat and wherein said top frame is substantially rigid when in a fully lowered position;

wherein, when said top frame is in a fully lowered position, said rear member of said top frame is positioned further forward in the forward section of the boat than said first forward pivot structure and said second forward pivot structure; and wherein the boat can be operated when said top frame is in a fully lowered position.

22. A boat top assembly as in claim 21, wherein, when said top frame is in a fully lowered position a first downward brake connected to the first rearward leg supports said first rearward leg and a second downward brake connected to the second rearward leg supports said second rearward leg.

23. A boat top assembly as in claim 21, wherein said top frame is substantially parallel to the deck surface when said top frame is in a fully lowered position.

24. A boat top assembly as in claim 21, further comprising a third cross member connecting said first forward leg to said second forward leg.

25. A boat top assembly for a boat having a deck surface and a forward section, said boat top assembly comprising:

a first forward leg adapted for connection to the boat, said first forward leg including a top and a first forward pivot structure that permits said first forward leg to pivot forward about said first forward pivot structure;

a second forward leg adapted for connection to the boat, said second forward leg including a top and a second forward pivot structure that permits said second forward leg to pivot forward about said second forward pivot structure;

a first rearward leg adapted for connection to the boat, said first rearward leg including a top and a first rearward pivot structure that permits said first rearward leg to pivot forward about said first rearward pivot structure;

a second rearward leg adapted for connection to the boat, said second rearward leg including a top and a second rearward pivot structure that permits said second rearward leg to pivot forward about said second rearward pivot structure;

a first cross member connecting said first forward leg and said first rearward leg, wherein said first cross member is connected to said first forward leg and said first rearward leg by leg pivots that permit said first forward leg and said first rearward leg to pivot forward towards the forward section of the boat in a coordinated manner; wherein said first cross member can be slidably adjusted along a portion of the length of said first forward leg;

a second cross member connecting said second forward leg and said second rearward leg, wherein said second cross member is connected to said second forward leg and the said second rearward leg by leg pivots that permit said second forward leg and said second rearward leg to pivot forward towards the forward section of the boat in a coordinated manner; wherein said second cross member can be slidably adjusted along a portion of the length of said second forward leg;

a top frame connected to the top of said first forward leg, the top of said second forward leg, the top of said first rearward leg, and the top of said second rearward leg, said top frame having a rear member;

a first downward brake connected to a forward side of said first rearward leg, wherein the first downward brake prevents said first rearward leg from pivoting further forward toward the forward section of the boat relative to said first rearward leg when said top frame is in a fully lowered position;

a second downward brake connected to a forward side of said second rearward leg, wherein the second downward brake prevents said second rearward leg from pivoting further forward toward the forward section of the boat relative to said second rearward leg when said top frame is in a fully lowered position;

a first assist connecting said first forward leg to said top frame; and a second assist connecting said second forward leg to said top frame;

wherein the coordinated pivoting forward of said first forward leg, said second forward leg, said first rearward leg, and said second rearward leg permits said top frame to rigidly move forward toward the forward section of the boat;

wherein, when the top frame is in the fully lowered position, said rear member of said top frame is positioned further forward in the forward section of the boat than said first forward pivot structure and said second forward pivot structure.

26. A boat top assembly for a boat having a deck surface and a forward section, said boat top assembly comprising:

means for covering a portion of the boat;

a plurality of legs adapted for connection to said boat, said legs including a top portion for connection to said means for covering and a means for pivoting said legs towards the forward section of the boat; and a means for connecting two or more of said legs and pivoting said top portions of said legs toward the forward section of the boat in a coordinated manner;

wherein the means for covering is further forward in the forward section of the boat than said means for pivoting when said means for covering is fully lowered in the forward section of the boat.

27. A boat top assembly as in claim 26, wherein said means for covering is substantially rigid and substantially parallel to the deck surface when such means for covering is in the fully lowered and fully raised positions.

28. A boat top assembly as in claim 26, including a means for braking one or more said legs from pivoting completely over to the forward portion of the boat.

29. A boat, comprising:

a deck surface with forward, starboard, and port sections;

a first forward leg adapted for connection to said boat, said first forward leg including a top and a first forward pivot structure that permits said first forward leg to pivot forward about said first forward pivot structure;

a second forward leg adapted for connection to said boat, said second forward leg including a top and a second forward pivot structure that permits said second forward leg to pivot forward about said second forward pivot structure;

a first rearward leg adapted for connection to said boat, said first rearward leg including a top and a first rearward pivot structure that permits said first rearward leg to pivot forward about said first rearward pivot structure;

a second rearward leg adapted for connection to said boat, said second rearward leg including a top and a second rearward pivot structure that permits said second rearward leg to pivot forward about said second rearward pivot structure;

a top frame connected to the top of said first forward leg, the top of said second forward leg, the top of said first rearward leg, and the top of said second rearward leg, said top frame having a rear member;

a first downward brake connected to the forward side of said first rearward leg, wherein the first downward brake prevents said first rearward leg from pivoting further forward then the position of said first rearward leg when said top frame is in a fully lowered position;

a second downward brake connected to the forward side of said second rearward leg, wherein the second downward brake prevents said second rearward leg from pivoting further forward then the position of said second rearward leg when said top frame is in a fully lowered position; and a first assist connecting said first forward leg to said first rearward leg; wherein said first assist facilitates the raising and lowering of said top frame; and a second assist connecting said second forward leg to said second rearward leg, wherein said second assist facilitates the raising and lowering of said top frame;

wherein, when said top frame is in a fully lowered position, said rear member of said top frame is positioned more forward in the forward section of said boat than said first and said second forward legs when the top frame is in the fully raised position;

wherein said boat top is rigid when in a fully lowered position;

wherein said boat can be operated when said top frame is in a fully lowered position; and wherein the top frame does not cover the boat section located on starboard side of said four leg pivots or the boat section located on the port said of said four leg pivots, when said top frame is in a fully lowered position.

30. A boat as in claim 29, wherein said boat can be operated during the lowering of said top frame.

31. A boat as in claim 29, wherein said boat is operated from the area underneath said top frame when said top frame is in a fully raised position.

32. A boat as in claim 29, wherein said top frame is substantially parallel with said deck surface of said boat when said top frame is in a fully lowered position.

33. A boat as in claim 29, wherein said top frame remains rigid during the raising and lowering of said top frame.

34. A boat as in claim 29, wherein, when said top frame is in a fully lowered position said first downward brake supports said first rearward leg and is supported by said first forward leg and said second downward brake supports said second rearward leg and is supported by said second forward leg.

35. A boat as in claim 29, further comprising at least one cross member connecting a pair of legs selected from:

said first forward leg and said first rearward leg;

said second forward leg and said second rearward leg; and said first forward leg and said second forward leg.

36. A boat as in claim 29, comprising:

a first cross member connecting said first forward leg and said first rearward leg, wherein said first cross member is connected to said first forward leg and said first rearward leg by leg pivots that permit said first forward leg and said first rearward leg to pivot forward towards the forward section of the boat in a coordinated manner; and a second cross member connecting said second forward leg and said second rearward leg, wherein said second cross member is connected to said second forward leg and the said second rearward leg by leg pivots that permit said second forward leg and said second rearward leg to pivot forward towards the forward section of the boat in a coordinated manner.

37. A boat as in claim 36, further comprising a third cross member connecting said first forward leg to said second forward leg.

38. A method of lowering a boat top assembly for a boat including forward, starboard, and port sections, providing a boat top assembly including: a first forward leg adapted for connection to the boat, said first forward leg including a top and a first forward pivot structure; a second forward leg adapted for connection to the boat, said second forward leg including a top and a second forward pivot structure; a first rearward leg adapted for connection to the boat, said first rearward leg including a top and a first rearward pivot structure; a second rearward leg adapted for connection to the boat, said second rearward leg including a top and a second rearward pivot structure; and a top frame connected to the top face of each said four legs, said top frame including a rear member;

unlocking said pivot structures to allow said four legs to pivot towards the forward section of the boat;

pivoting said legs towards the forward section of the boat, wherein pivoting said four legs lowers said top frame and moves said top frame in a forward direction; and sliding said top frame towards the forward section of the boat when lowering said top frame until said top frame is in a fully lowered position;

wherein the top frame remains rigid when said top frame is lowered; and wherein when said top frame is in a fully lowered position, said rear member of said top frame is positioned more forward in the forward section of the boat than said first forward pivot structure and said second forward pivot structure.

39. A method of lowering a boat top assembly as in claim 38, wherein the boat may still be controlled from the section of the boat underneath said top frame in a fully raised position, when said top frame is in a fully lowered position.

40. A method of lowering a boat top assembly as in claim 38, wherein the sections located on the port and starboard sides of said pivot structures remain uncovered by said top frame when said top frame is in a fully lowered position.

* * * * *